US008672124B2

(12) United States Patent
Burgess et al.

(10) Patent No.: US 8,672,124 B2
(45) Date of Patent: Mar. 18, 2014

(54) STACKABLE GUIDE WIRE CONTAINER WITH LIVING HINGE

(75) Inventors: James E. Burgess, Mundelein, IL (US); John Henry Kutsch, Harvard, IL (US)

(73) Assignee: Medline Industries, Inc., Mundelein, IL (US)

( * ) Notice: Subject to any disclaimer, the term of this patent is extended or adjusted under 35 U.S.C. 154(b) by 1001 days.

(21) Appl. No.: 12/348,095

(22) Filed: Jan. 2, 2009

(65) Prior Publication Data

US 2010/0170816 A1 Jul. 8, 2010

(51) Int. Cl.
*B65D 85/04* (2006.01)

(52) U.S. Cl.
USPC ..... 206/303; 206/363; 206/438

(58) Field of Classification Search
USPC ..... 206/303, 408, 476, 63.3, 560, 565, 415, 206/53, 55, 702, 488, 784, 490, 487, 389, 206/33; 220/743
See application file for complete search history.

(56) References Cited

U.S. PATENT DOCUMENTS 912,796 A * 2/1909 Boye ..... 206/389
1,908,278 A * 5/1933 Brown ..... 242/137.1
3,495,703 A * 2/1970 Calabrese ..... 206/63.3
3,670,875 A * 6/1972 Jones ..... 206/408
4,915,216 A * 4/1990 Magers ..... 206/520
4,936,448 A 6/1990 Holloway
5,056,658 A * 10/1991 Sobel et al. ..... 206/63.3
5,236,083 A * 8/1993 Sobel et al. ..... 206/63.3
D364,564 S * 11/1995 Moore ..... D9/429
5,490,595 A * 2/1996 Sakai et al. ..... 206/408
5,738,213 A * 4/1998 Whiting et al. ..... 206/364
6,076,659 A * 6/2000 Baumgartner et al. ..... 206/63.3
D433,130 S * 10/2000 Cude et al. ..... D24/121
6,691,946 B2 * 2/2004 Dannecker et al. ..... 242/588.6
2002/0157981 A1 * 10/2002 Whiting et al. ..... 206/438
2003/0192890 A1 * 10/2003 Mazzarolo ..... 220/254.3
2004/0195239 A1 * 10/2004 Rush et al. ..... 220/254.3
2004/0211692 A1 * 10/2004 Bordner et al. ..... 206/389
2006/0255038 A1 * 11/2006 Hollis et al. ..... 220/254.3
2007/0256945 A1 * 11/2007 Kennedy et al. ..... 206/63.3

* cited by examiner

*Primary Examiner* — David Fidei
(74) *Attorney, Agent, or Firm* — David Noskowicz; Philip H. Burrus, IV

(57) ABSTRACT

A container (200) is configured to retain a coiled device, such as a guide wire, within the container (200). The container (200) includes a bowl (201) and one or more retention devices (230). Each retention device (230) includes a retention tab (206) that is coupled to the bowl (201) by a hinge (207). The bowl (201) and retention tabs (206) can be manufactured as an integral component by using living hinges as the hinge (207). The containers (200) are configured to be efficiently stacked when the retention tabs (206) are rotated to an open position.

16 Claims, 6 Drawing Sheets

STACKABLE GUIDE WIRE CONTAINER WITH LIVING HINGE

BACKGROUND

1. Technical Field

This invention relates generally to a device for storing medical equipment, and more particularly to a container, such as a bowl, for retaining a coiled device in a solution.

2. Background Art

Certain medical procedures, due to their nature, require the use of devices or equipment that can be awkward to handle, package, or store. For example, guide wires, which are used to direct catheters to locations within the body, are long, flexible devices that are resistant to coiling. Other similar devices that resist coiling include flexible stents, catheters, tubing, wires, fiber optic equipment, and so forth. When coiled, these devices have a tendency to expand outwardly in a radial manner. Controlling these devices is critical during medical procedures, as unintended contact with objects in an operating environment can compromise function or sterility.

To illustrate by way of example, a guide wire is often used to insert a catheter into the cardiovascular system of a patient. Guide wires are roughly five feet in length and are resistant to coiling. The guide wire is inserted into a blood vessel and is directed to a treatment location within the cardiovascular system. A catheter may then be placed about the guide wire so that it can traverse to the treatment location along the guide wire. The guide wire can then be withdrawn from the patient. Guide wires are also used in other medical procedures, such as ultrasound, medication delivery, diagnostic procedures, and so forth.

Before the guide wire can be inserted into the patient, it must be prepared for use. A medical professional will generally remove the guide wire from a coiled, rigid packaging. The medical professional will then coil the guide wire and place it into a container that is filled with a solution, such as a heparin solution. When ready to use the guide wire, the medical professional removes the guide wire from the container and from the solution.

There are many guide wire containers available on the market. However, many problems exist with these containers. For instance, as noted above, guide wires are resistant to coiling. Consequently, prior art containers often include vertical or inverted sidewalls. This is due to the fact that if the container includes an outwardly tapering sidewall, the guide wire can expand up the wall, using the wall as a ramp, and leap out of the solution. The problem with vertical or inverted sidewalls is that manufacturing such containers is difficult and expensive. Specifically, undercuts or expensive molding techniques are required, each of which greatly increases the cost of the container.

Other containers include notches projecting into the bowl. In these containers, the problems compound. Not only do the notches present the same undercut problems mentioned in the preceding paragraph, but they also present stacking problems. Specifically, the notches and projections cause interference with other containers when the containers are stacked. This results in greatly increased manufacturing and transportation costs, as fewer containers can be shipped within a box or vehicle.

There is thus a need for an improved container for coiled medical devices that can retain a coiled device within a solution, yet is simpler to manufacture and offers greater stacking efficiency.

Figure 1:
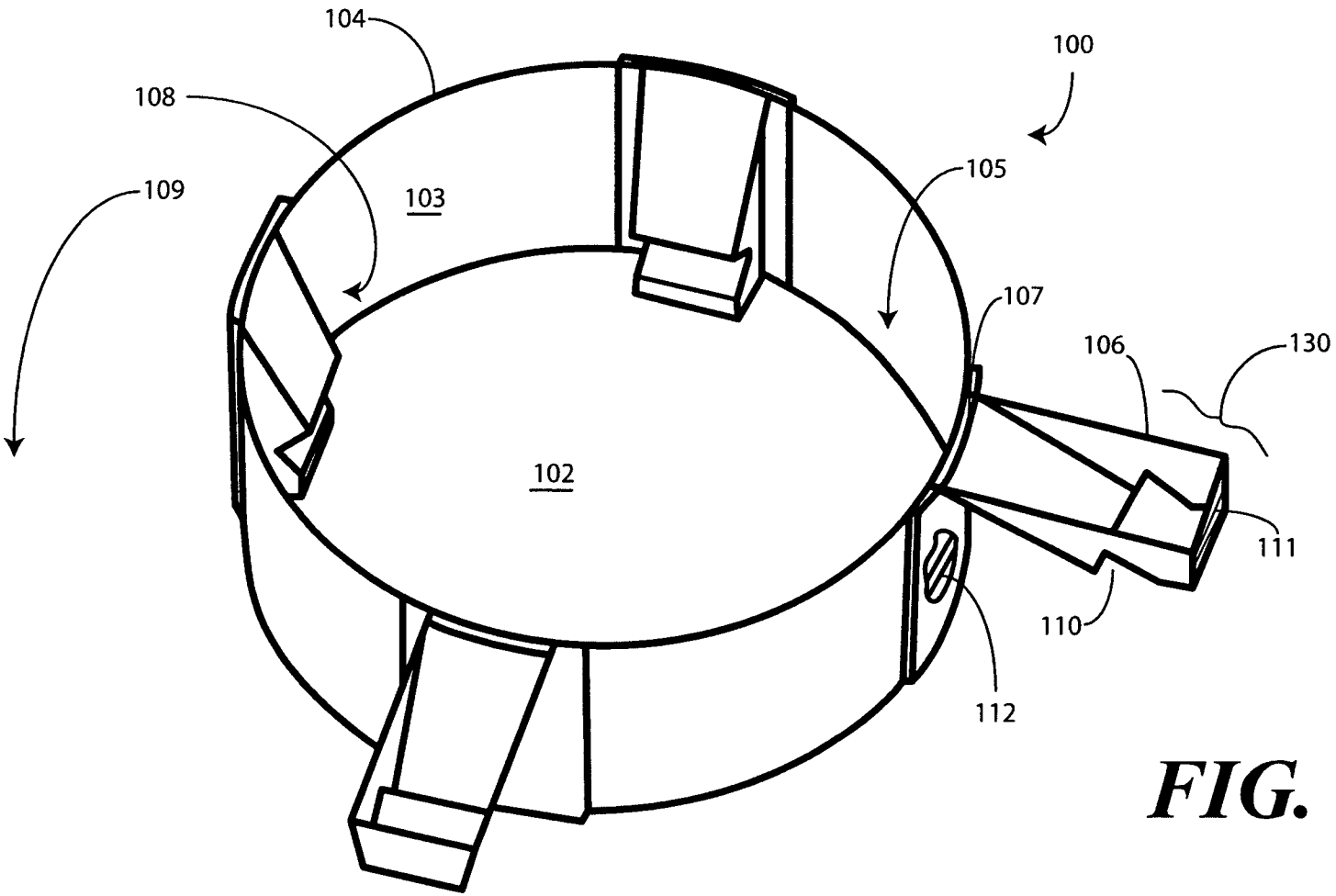
FIG. 1 illustrates a perspective view of one container configured to retain a coiled device in a solution in accordance with embodiments of the invention.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments of the present invention.

DETAILED DESCRIPTION OF THE INVENTION

Embodiments of the invention are now described in detail. Referring to the drawings, like numbers indicate like parts throughout the views. As used in the description herein and throughout the claims, the following terms take the meanings explicitly associated herein, unless the context clearly dictates otherwise: the meaning of "a," "an," and "the" includes plural reference, the meaning of "in" includes "in" and "on." Relational terms such as first and second, top and bottom, and the like may be used solely to distinguish one entity or action from another entity or action without necessarily requiring or implying any actual such relationship or order between such entities or actions. Also, reference designators shown herein in parenthesis indicate components shown in a figure other than the one in discussion. For example, talking about a device (10) while discussing figure A would refer to an element, 10, shown in figure other than figure A. Further, it is expected that one of ordinary skill, notwithstanding possibly significant effort and many design choices motivated by, for example, available time, current technology, and economic considerations, when guided by the concepts and principles disclosed herein will be readily capable of generating such containers with minimal experimentation.

Embodiments of the invention provide a container configured to retain a coiled device, such as a guide wire, in a solution. Specifically, in one embodiment, the container includes a bowl with a retention device for retaining the guide wire in the solution. In one embodiment, the retention device includes a retention tab that is coupled to the bowl by a hinge. As such, the retention tab is pivotable and can be moved from a first position outside the perimeter of the rim of the bowl to a second position within the interior portion of the bowl. When the retention tab is in the first position, the bowl can be stacked with other bowls having their retention tabs in the first position with great efficiency. When the retention tab is in the second position, in one embodiment it engages a step member to retain the coiled device within the bowl.

Retention devices in accordance with embodiments of the present invention offer numerous advantages over prior art containers. First, the use of a retention device means that the bowl, in one embodiment, can be manufactured with sidewalls that taper outward from the base member. As such, containers in accordance with embodiments of the present invention are well suited for manufacture by way of a injection molding process, as the sidewall configuration ensures that the container is easily removable from the mold.

Second, as the retention tabs are connected by a hinge, there is no need for undercuts in the tooling. The container can be manufactured with the retention tabs in the first position without undercuts. However, when the retention tab is later pivoted to the second position, a positive retention feature is created for holding the coiled device within the container. Thus, the container can be manufactured with no undercuts, thereby reducing cost, while the container in use functions as if it did have undercuts incorporated in the design.

Third, containers in accordance with embodiments of the present invention can be stacked with great efficiency. While prior art bowls having steps and other physical features within the interior of the bowl are only capable of stacking with a density of two bowls per inch height, embodiments of the present invention can stack with a density of five to six bowls per inch.

In one embodiment, the retention tabs are molded to the rim of the container with a living hinge integrated between the rim and the retention tab. The living hinge allows the retention tab to rotate about the rim, into the container, for holding the coiled device within the container. However, when being transported or stored, the retention tab can be rotated out of the container to allow for proper stacking.

Turning now to FIG. 1, illustrated therein is one embodiment of a container 100 that is configured to retain a coiled device in a solution. For discussion purposes, the container 100 will be described for use in holding a guide wire within a heparin solution. However, it will be obvious to those of ordinary skill in the art having the benefit of this disclosure that the invention is not so limited. The container 100 can be used to hold other devices, including flexible stents, catheters, tubing, wires, fiber optic equipment, and so forth. Further, the container 100 can simply be used for retaining devices—they need not be in a solution.

In the illustrative embodiment of FIG. 1, the container 100 is configured as a bowl 101. This shape is useful when the coiled device is to be retained in a solution, such as when a guide wire is retained in a heparin solution. While the illustrative bowl 101 of FIG. 1 is shown as being round, it will be clear to those of ordinary skill in the art that the invention is not so limited. The bowl 101 could equally be square, hexagonal, triangular, or have some other sectional shape.

The bowl 101 includes a base member 102, a sidewall 103, and a rim 104. The sidewall 103 can be one continuous sidewall, or alternatively may be a set of interconnected sidewalls, as would be the case if the cross sectional shape of the bowl 101 was a square. The bowl 101 includes an inner surface 105 that runs from the base member 102 up the sidewall 103 to the rim 104.

In one embodiment, the sidewall 103 projects upward away from the base member 102 and terminates at the rim 104. In one embodiment, the sidewall 103 tapers outward from the base member 102 as it projects upward from the base member 102 to facilitate easy removal from a mold and ease in stacking.

In one embodiment, the sidewall 103 takes on a complex shape as it projects upward from the base member 102. For instance, as the sidewall 103 initially projects upward from the base member 102, it may have a mild taper, such as between two and ten degrees. Such a configuration can make it easier to place a guide wire within the bowl 101. As the sidewall 103 continues to project away from the base member 102, the sidewall may taper more radically away from the base member 102, such as between ten and thirty degrees.

In one embodiment, the bowl 101 is manufactured by an injection molding process. The bowl 101 can be manufactured by molding thermoplastic, such as polypropylene. In one embodiment, the bowl 101 is manufactured such that the bowl's constituent parts have a thickness of between thirty-thousandths and fifty-thousandths of an inch.

The container 100, in one embodiment, includes at least one retention device 130. The retention device 130 is coupled to the bowl by way of a hinge 107. In one embodiment, the hinge 107 comprises a living hinge manufactured from the same material as the bowl 101. However, the thickness of the living hinge will generally be less than that of, for example, the sidewall 103, to facilitate a hinging action. By configuring the hinge 107 as a living hinge, the bowl 101, retention device 130, and hinge 107 can all be manufactured from the same material, in the same mold, by the same process. When manufacturing the container 100 with the retention device 130 coupled by a living hinge, there is no need for costly, time consuming manufacturing techniques such as collapsible core molds or slides for undercuts. Embodiments of the present invention can be tooled without undercuts or negative drafts.

The bowl 101 defines an interior region 108 and an exterior region 109. When the container 100 is to be used to retain a guide wire in a heparin solution, the solution may be poured into the interior region 108 of the bowl 101.

In one embodiment, the retention tab 106 includes a retaining detent 110 for retaining the coiled device within the bowl 101. When the retention tab 106 is rotated into the interior region 108 of the bowl 101, the retaining detent 110 is exposed to the interior region 108 of the bowl. The guide wire then engages the retaining detent 110 when placed within the interior region 108 of the bowl. When the guide wire tries to uncoil, the retaining detent ensures that the guide wire stays beneath the rim 104 and within the bowl.

In one embodiment, to "latch" the retention tab 106 against the inner surface 105 of the bowl 101, the retention tab 106 includes a coupling feature 111. The inner surface 105 of the bowl 101 then includes a corresponding coupling feature 112. By way of example, the coupling feature 111 of the retention tab 106 may be a positive mechanical structure, such as a ridge, while the coupling feature 112 of the inner surface 105 may be a complimentary mechanical structure such as a recess. When the retention tab 106 pivots about the hinge 107, the coupling feature 111 of the retention tab 106 eventually locks within the coupling feature 112 of the inner surface 105 so as to latch the retention tab 106 within the bowl 101.

In one embodiment, the hinge 107 is designed to be a single use living hinge. For example, the container 100 maybe manufactured at a supplier location by way of an injection molding process. To simplify the tool, the container 100 is manufactured with the retention tab 106 extending toward the exterior region 109 from the rim 104. The supplier then stacks the containers 100 with the retention tabs 106 in the outward position, as the containers are configured to be stackable in this configuration. The supplier then ships the containers 100 to an OEM.

The OEM may then choose to rotate the retention tabs 106 into the interior region 108 of the bowl 101. The container 100 may be packaged with other supplies, such as medical products, a guide wire, and so forth. The OEM may then ship these assemblies as individual units to medical suppliers.

Figure 2:
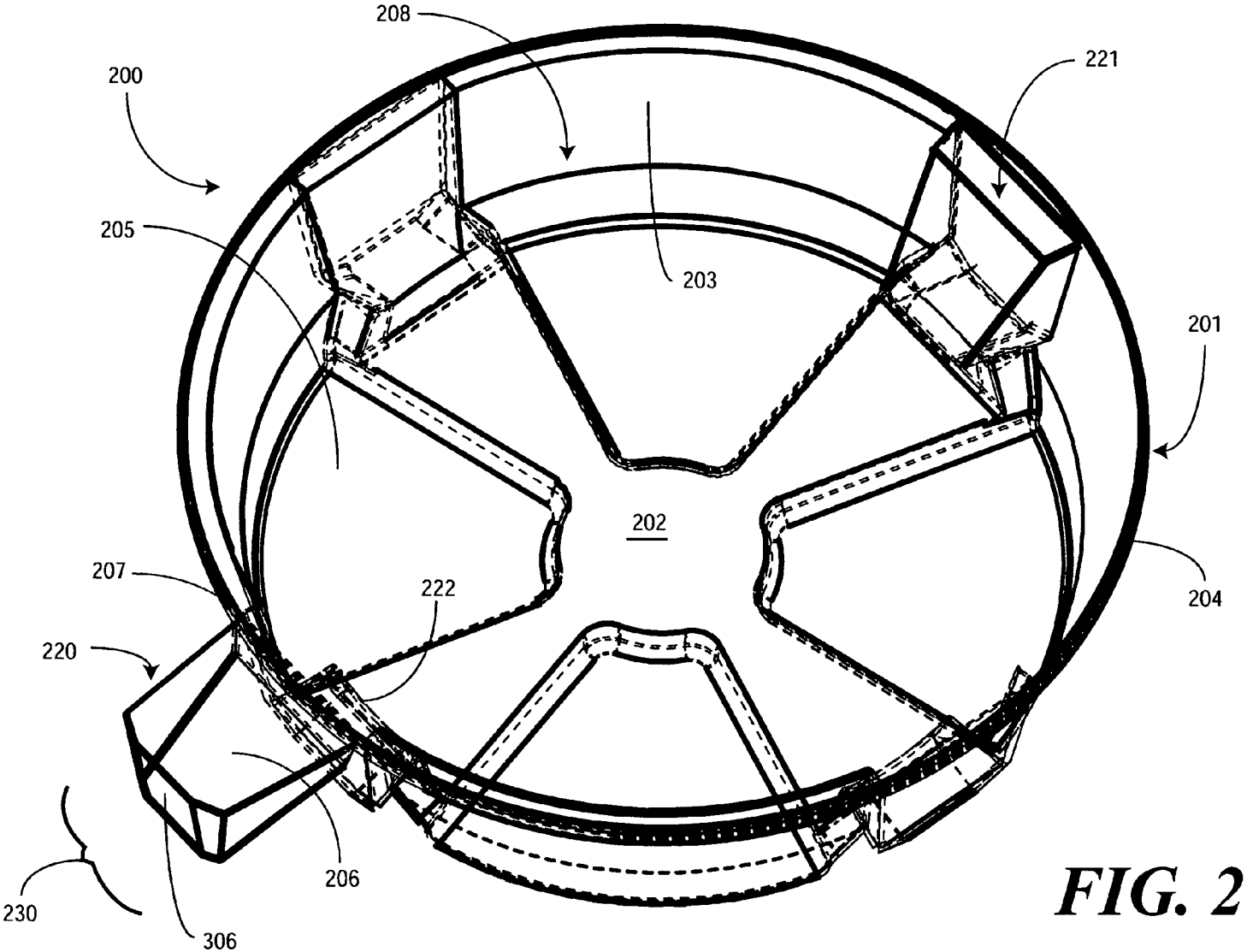
FIG. 2 illustrates a perspective view of one container configured to retain a coiled device in a solution in accordance with embodiments of the invention.
Figure 3:
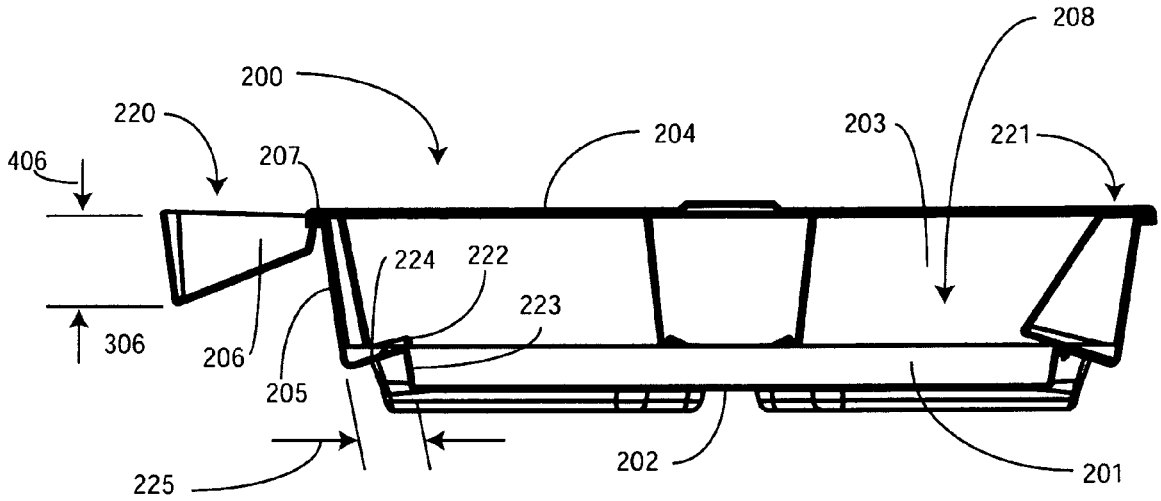
FIG. 3 illustrates a side, elevation view of one container configured to retain a coiled device in a solution in accordance with embodiments of the invention.
Figure 4:
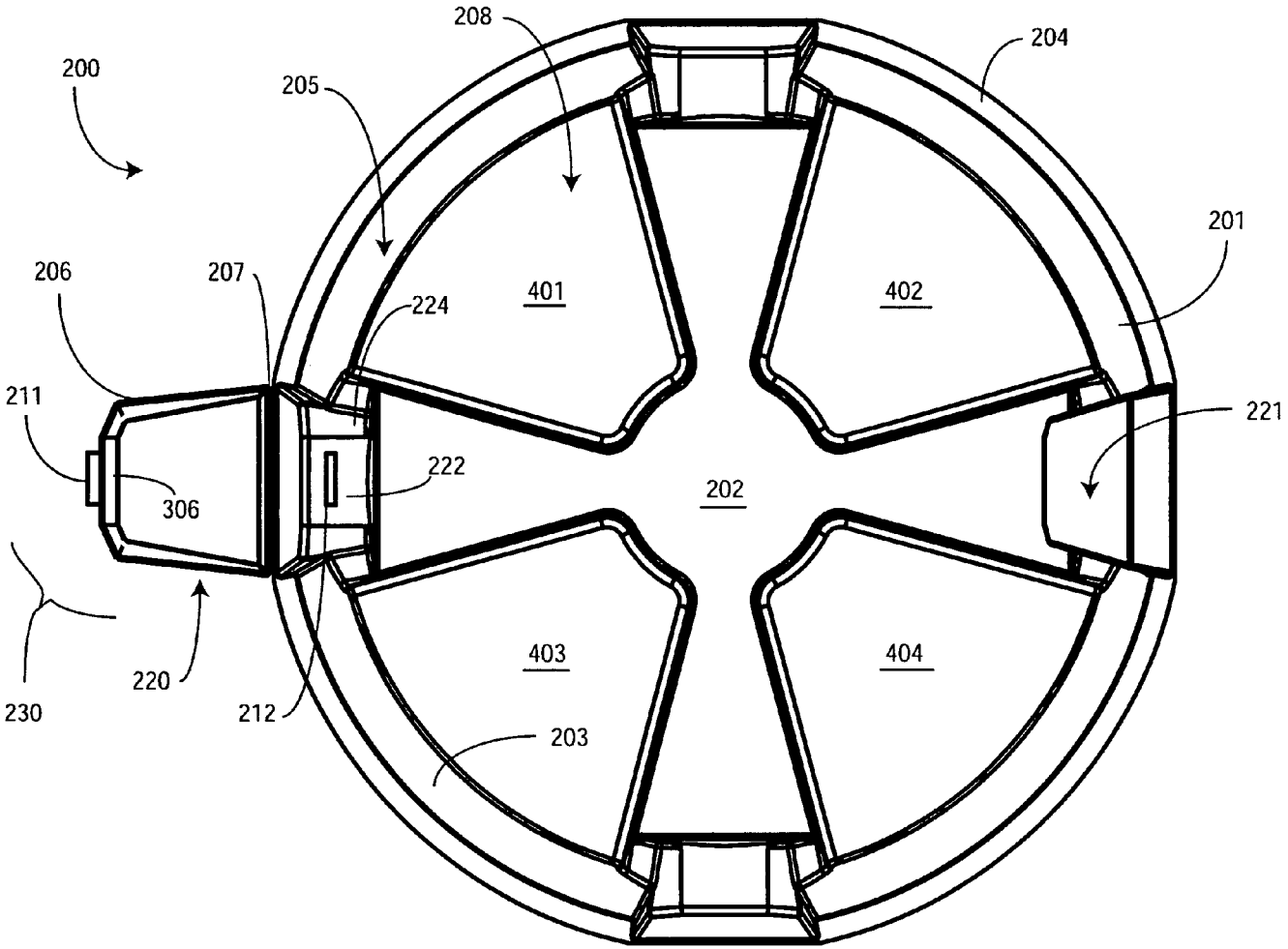
FIG. 4 illustrates a top, plan view of one container configured to retain a coiled device in a solution in accordance with embodiments of the invention.

Turning now to FIGS. 2-4, illustrated therein is an alternate container 200 that is configured to retain a coiled device, such as a guide wire, in accordance with embodiments of the present invention. FIG. 2 is a perspective view, while FIG. 3 is a side, elevation, sectional view. FIG. 4 is a top plan view.

A bowl 202 includes a base member 202 and a rim 204, which define an interior region 208. In one embodiment, the bowl has a volume of between four and five cubic inches. In one embodiment, the base member 201 is between seven and eight inches. The rim 204, in one embodiment, is between two and three inches above the base member 202.

One or more retention devices 230 are configured to retain the coiled device within the bowl 201. In one embodiment, the container 200 includes a plurality of retention devices 206, with each retention device 230 including a retention tab 206. Note that the container 200 could include two, three, four, or more retention devices 230. In the illustrative embodiment shown in FIGS. 2-4, each retention tab 206 occupies between two and three cubic inches within the bowl 201. The retention tabs 206 are coupled to the rim 204 by a living hinge that is configured to permit rotation of the retention tab 206 about the rim roughly 270 degrees.

As shown in FIGS. 2-4, one or more retention tabs 206 are hingedly coupled to the rim 204 so as to be pivotable from a first position 220 to a second position 221. The first position 220 is outside a perimeter defined by the rim 204, while the second position 221 is within the interior region 208. The container 200 is configured to be efficiently stackable when the retention tabs 206 are in the first position 220. When the retention tabs 206 are in the second position 221, the container 200 is configured to retain a coiled device within a solution.

In the illustrative embodiment of FIGS. 2-4, the retention devices 230 are two part structures. The retention devices 230 include both the retention tab 206 and a step member 222. The step member 222 functions as a "retention step" in that it works to both keep the coiled device within the bowl 201 and the retention tabs 206 in a latched position.

In one embodiment, the step member 222 is integrated with the bowl 201 in that it is molded integrally with the bowl 201. The step member 222 projects towards the interior region 208 along the interior surface 205 of the bowl 201.

In one embodiment, each step member 222 includes a wall 223 and a ledge 224. The wall 223 extends toward the interior region 208 from the base member 202, while the ledge 224 extends toward the interior region 208 from the sidewall 203. In one embodiment, the wall 223 extends from the base member 202 at an outwardly inclined angle, such as between five and twenty degrees. Similarly, the sidewall 203 projects away from the base member at an outwardly inclined angle. In one embodiment, the ledge 224 projects away from the sidewall 203 at a slightly acute angle, such as between eighty and ninety degrees. The outward angle of projection of the sidewall 203 and the outward projection angle of the wall 223 can be the same. Alternatively, these angles can be different.

The ledge 224 has a ledge length 225 associated therewith. The ledge length 225 is defined by the distance between the wall 223 and the sidewall 203 spanned by the ledge 224. In one embodiment, the ledge length 225 is used to suspend the guide wire away from the sidewalls 203. This can be beneficial in that it helps a healthcare professional in removing the guide wire from the bowl 201, in that they are able to more readily wrap their fingers about the guide wire.

The retention tab 206 has an engagement surface 306 that is configured to engage the ledge 224 when the retention tab 206 is pivoted about the hinge 207 toward the interior region 208. The engagement surface 306 functions as a retention surface, in that it works—in one embodiment—to retain the retention tab 206 within the bowl 201 when the retention tab 206 is pivoted about the hinge 207 toward the interior region 208 of the bowl 201. The engagement surface 306 has an engagement surface length 406 associated therewith. In one embodiment, the engagement surface length 406 is greater than the ledge length 225 such that an "overhang" is created when the retention tab 206 is pivoted such that the engagement surface 306 fully engages the ledge 224.

Figure 5:
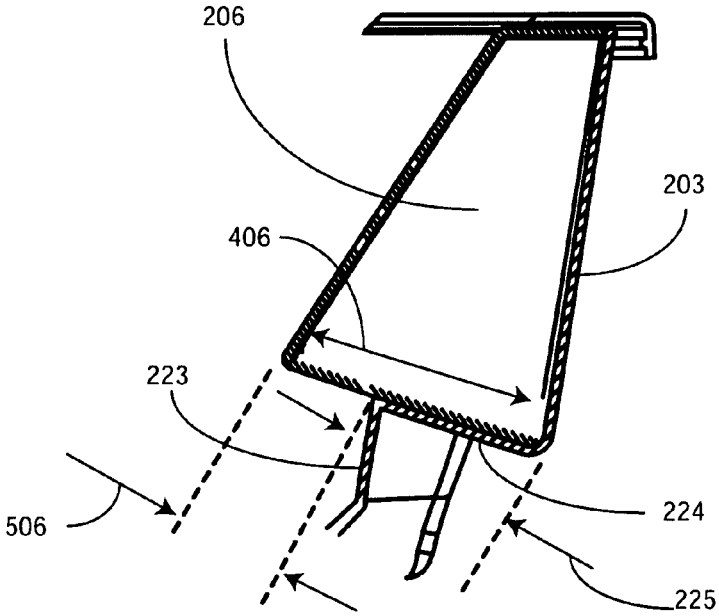
FIG. 5 illustrates a sectional view of a retention tab engaging a step member in accordance with embodiments of the invention.

Turning briefly to FIG. 5, illustrated therein is such a configuration. The retention tab 206 has been fully rotated to the interior (208) of the bowl (201). The sidewall 203 has limited movement of the retention tab 206 by acting as a stop for the engagement surface 306.

In the illustrative embodiment of FIG. 5, an overhang 506 is created because the engagement surface length 406 is greater than the ledge length 225. Said differently, where the engagement surface 306 and the ledge 224 have roughly the same widths, the surface area of the ledge 224 is less than the surface area of the engagement surface 306. As such, the overhang 506 is created. When a coiled device is inserted into the bowl (201) with the retention tab 206 engaging step member (222), the overhang 506 retains the coiled device within the bowl (201).

In one embodiment, the overhang 506 is configured to be non-parallel with the plane defined by the base member 202. This is done to make guide wire removal easier. Were the angle of the overhang 506 horizontal, there is a possibility for gaps to form between the engagement surface 306 and the ledge 224 due to manufacturing tolerances. This provides the opportunity for the guide wire to slip into such a gap, which makes its removal from the bowl (201) more difficult. By making the overhang 506 extend at a non-horizontal angle, the guide wire is prohibited from slipping into any gap that may exist between the engagement surface 306 and the ledge 224.

Turning back to FIG. 4, as with the container (100) of FIG. 1, coupling devices can be added to the retention tab 206 and the step member 222 to secure the retention tab 206 within the bowl 201. For example, in one embodiment a first coupling feature 211 can be included along the engagement surface 306, while a second coupling feature 212 can be included along the ledge 224. The first coupling feature 211 is configured to engage the second coupling feature 212 when the retention tab 206 is pivoted about the hinge 207 toward the interior region 208 and toward the sidewall 203. Alternatively, the engagement surface 306 may be held against the ledge 224 by friction only.

As can also be seen in FIG. 4, in one embodiment the bowl 201 includes one or more recesses 401,402,403,404. These recesses 401,402,403,404 can permit solution to pass beneath the coiled device when the coiled device is held within the container 200. In the illustrative embodiment of FIG. 4, each recess is disposed between a pair of retention devices. In one embodiment, the recesses 401,402,403,404 have a depth of less than one inch. In one embodiment, the recesses 401,402,403,404 are used to suspend the guide wire away from the base member 202. This can be beneficial in that it helps a healthcare professional in removing the guide wire from the bowl 201, in that they are able to more readily wrap their fingers about the guide wire.

Figure 6:
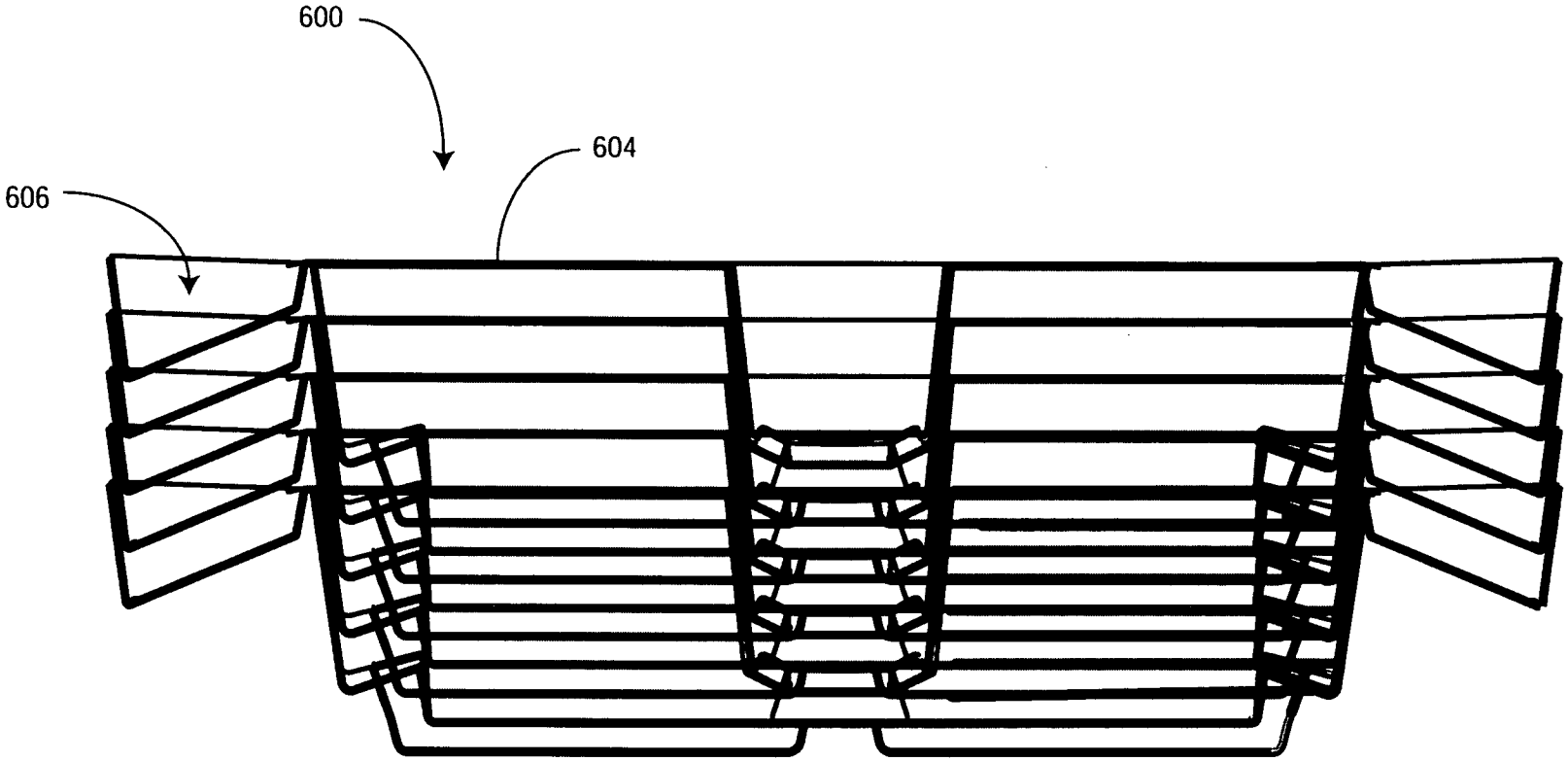
FIG. 6 illustrates a side, elevation view of containers configured to retain a coiled device in a solution in accordance with embodiments of the invention in a stacked configuration.

Turning now to FIG. 6, illustrated therein are a plurality of bowls 600 in a stacked configuration. The plurality of bowls is stacked with the retention tabs 606 in an extended, open position relative to the rims. Using bowl dimensions as described with reference to FIGS. 2-4, testing has shown that five bowls can easily be stacked with a total height of less than 4.5 inches. This results in a 100 percent efficiency increase in stackability when compared to prior art containers.

Figure 7:
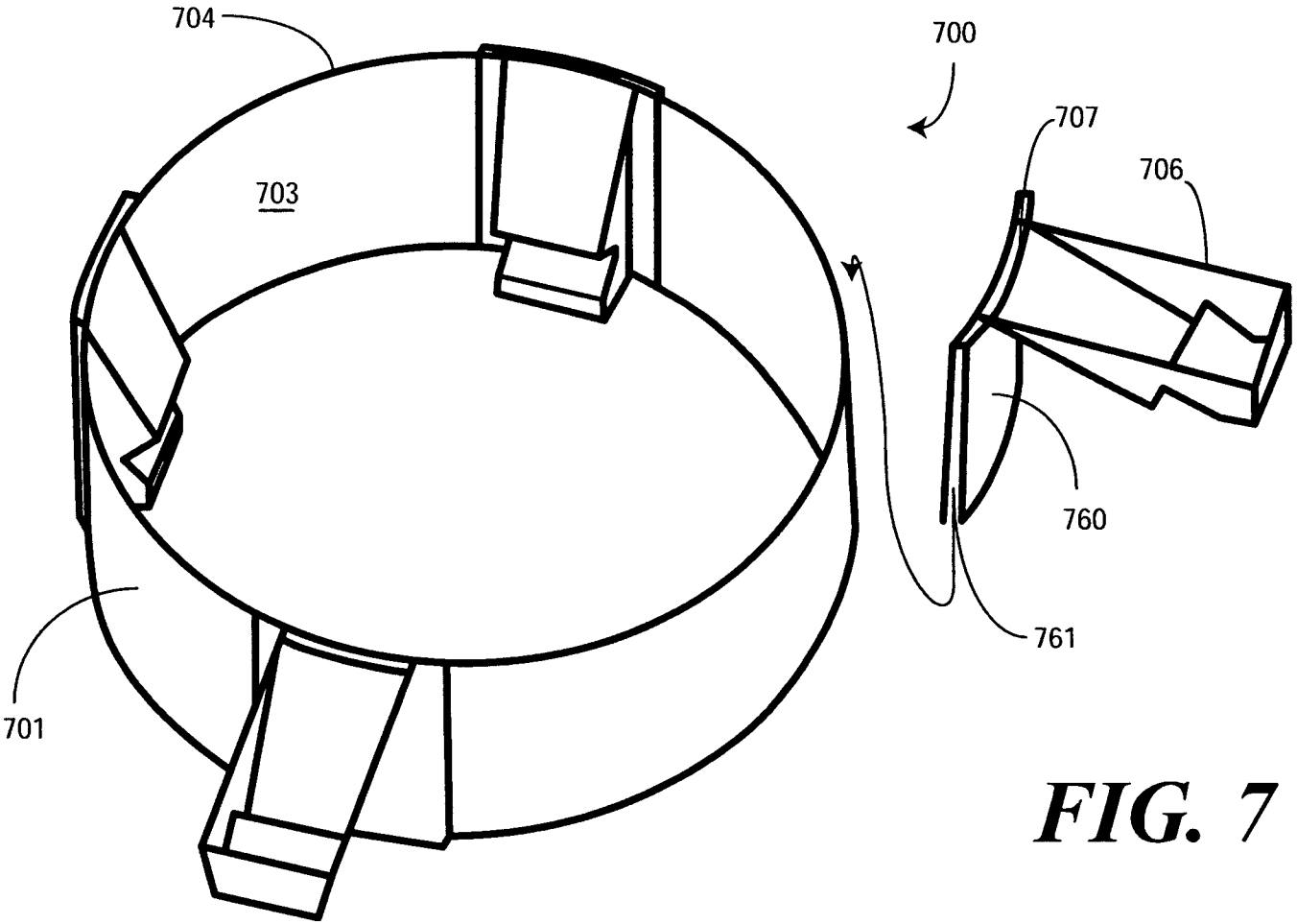
FIG. 7 illustrates a perspective view of one embodiment where the hinge is detachable from the bowl in accordance with embodiments of the invention.

Turning now to FIG. 7, illustrated therein is an alternate embodiment of a container 700 configured to retain a coiled device in a solution where the retention tab 706 is selectively detachable from the bowl 701. Such an embodiment is suitable, for example where an existing bowl is to be retrofitted with retention tabs 706 for holding the coiled device in the solution.

In the embodiment of FIG. 7, the retention device 706 is coupled to a mounting device 760 by a hinge 707. In the illustrative embodiment of FIG. 7, the mounting device 760 includes a coupling notch 761 that slides over the rim 704 of the bowl 701. The mounting device 760 can be made from a flexible material, such as a thermoplastic, such that it easily conforms to the bowl 701, sliding along and gripping the sidewall 703.

In the foregoing specification, specific embodiments of the present invention have been described. However, one of ordinary skill in the art appreciates that various modifications and changes can be made without departing from the scope of the present invention as set forth in the claims below. Thus, while preferred embodiments of the invention have been illustrated and described, it is clear that the invention is not so limited. Numerous modifications, changes, variations, substitutions, and equivalents will occur to those skilled in the art without departing from the spirit and scope of the present invention as defined by the following claims. Accordingly, the specification and figures are to be regarded in an illustrative rather than a restrictive sense, and all such modifications are intended to be included within the scope of present invention. The benefits, advantages, solutions to problems, and any element(s) that may cause any benefit, advantage, or solution to occur or become more pronounced are not to be construed as a critical, required, or essential features or elements of any or all the claims.

What is claimed is:

1. A container configured to retain a coiled device in a solution, comprising:

an bowl having a base member and a rim and defining an interior portion; and at least one retention tab hingedly coupled to the rim so as to be pivotable from a first position outside a perimeter defined by the rim to a second position latched against a sidewall of the bowl within the interior portion.

2. The container of claim 1, wherein the at least one retention tab defines a retaining detent exposed to the interior portion when the at least one retention tab is in the second position.

3. The container of claim 1, wherein the at least one retention tab comprises a plurality of retention tabs, each being integral with the bowl by a living hinge coupled to the rim.

4. The container of claim 1, wherein the container is configured to be stackable when the at least one retention tab is in the first position.

5. The container of claim 1, the at least one retention tab comprising a step member integrated with the bowl so as to project towards the interior portion.

6. The container of claim 5, the step member comprising:

a wall extending toward the interior portion from the base member; and a ledge extending toward the interior portion;

the ledge defining a ledge length.

7. The container of claim 6, the at least one retention tab comprising an engagement surface to engage the ledge when the at least one retention tab is pivoted toward the interior portion.

8. The container of claim 7, the engagement surface comprising a first coupling feature, wherein the ledge comprises a second coupling feature.

9. The container of claim 8, the first coupling feature to engage the second coupling feature when the at least one retention tab is pivoted toward the interior portion.

10. The container of claim 1, further comprising a living hinge between the at least one retention tab and the rim.

11. The container of claim 10, the living hinge integrally with the bowl at the rim.

12. The container of claim 1, the bowl manufactured from a thermoplastic material.

13. The container of claim 12, the thermoplastic material comprising polypropylene.

14. The container of claim 1, the at least one retention device comprising a plurality of retention devices.

15. The container of claim 1, the base member defining a plurality of recesses.

16. The container of claim 1, the at least one retention tab hinge detachable from the bowl.

* * * * *